United States Patent [19]

Hughes

[11] Patent Number: 4,528,699

[45] Date of Patent: Jul. 16, 1985

[54] CLOTHING FOR BREAST FEEDING

[76] Inventor: Stephanie D. Hughes, 103 Woodland Dr., Pittsburgh, Pa. 15228

[21] Appl. No.: 639,680

[22] Filed: Aug. 9, 1984

Related U.S. Application Data

[63] Continuation of Ser. No. 478,367, Mar. 24, 1983.

[51] Int. Cl.[3] ..... A41D 1/04

[52] U.S. Cl. ..... 2/104

[58] Field of Search ..... 2/104, 114, 105, 74, 2/76, 79

[56] References Cited

U.S. PATENT DOCUMENTS

| | | | |
|---|---|---|---|
| 907,290 | 12/1908 | Rouff | 2/104 |
| 1,206,480 | 11/1916 | Stagg | 2/104 |
| 1,290,142 | 1/1919 | Elowsky | 2/104 |
| 3,423,761 | 1/1969 | Nickerson | 2/104 |
| 4,004,294 | 1/1977 | Pinch | 2/104 |
| 4,144,593 | 3/1979 | Timmons | 2/104 |

*Primary Examiner*—Doris L. Troutman

*Attorney, Agent, or Firm*—Robert D. Yeager; Christine R. Ethridge

[57] ABSTRACT

Improved clothing to be worn by a woman for breast feeding a baby which includes an upper member having a lower edge and a lower member having an upper edge. The upper edge of the lower member is made of such a resilient material that the upper edge tends to assume a nonaccess position, covering the breasts, but which can be pulled down to an access position under the breast to make it accessible to the baby. The upper and lower members are so positioned relative to each other when worn by a woman that at least a portion of the upper member overlaps the lower member. The lower edge of the upper member is suspended to an area below the breast to permit the upper member to shield the breast when the upper edge of the lower member is in either the access or nonaccess positions.

15 Claims, 5 Drawing Figures

CLOTHING FOR BREAST FEEDING

This is a continuation of my copending application Ser. No. 478,367, filed on Mar. 24, 1983. A verified statement claiming small entity status has been filed and remains proper for purposes of the present continuation application.

BACKGROUND OF THE INVENTION

1. Field of the Invention

This invention relates to women's wearing apparel, and, more particularly to clothing that enables mothers to unobtrusively breast feed their babies.

2. Description of the Prior Art

The need for clothing to make breast feeding possible without having to undress has been recognized for centuries by societies clothed for warmth and modesty. The need has been addressed by more than twenty prior U.S. patents which have issued over the last century. Some of those patents have been directed toward underwear and sleepwear, while others have been directed towards dresses and blouses for mothers nursing babies. The present invention can function for sleepwear, lingerie and other underwear; however, the major application is for apparel worn in public.

The majority of prior art nursing apparel includes a vertical slit, which is unobtrusive when not in use for feeding but which spreads open to expose the breast when the child is nursing. Duenckel U.S. Pat. No. 232,246 which issued on Sept. 14, 1880; Coyle U.S. Pat. No. 660,843, which issued on Oct. 30, 1900; Jacoby U.S. Pat. No. 1,013,778, which issued on Jan. 2, 1912; and Gerich U.S. Pat. No. 2,911,650, which issued on Nov. 10, 1959 are illustrative.

References to "vertical" as used herein shall mean vertical relative to the waist of the wearer of the garment and to the floor when such wearer stands erect. "Horizontal" as used herein shall mean horizontal relative to the waist of a wearer of the garment and to the floor when such wearer stands erect.

Garments have been devised which minimized, and in some cases attempted to avoid, exposure of the nipple, areola and adjacent flesh. Coyle U.S. Pat. No. 778,014 which issued on Dec. 20, 1904, discloses a foldable side flap. Culver U.S. Pat. No. 890,614, which issued on June 16, 1908, discloses a pullout flexible curtain for shielding the breast during feeding. Rouff U.S. Pat. No. 907,290, which issued on Dec. 22, 1908, discloses a swinging placket. A garment showing a button-down flap which folds up to expose the breast during feeding is disclosed by Elowsky U.S. Pat. No. 1,290,142 which issued on Jan. 7, 1919. Dodd U.S. Pat. No. 4,106,122, which issued on Aug. 15, 1978, discloses a halter with pleated flaps which extends down over the breasts.

Timmons U.S. Pat. No. 4,144,593, which issued on Mar. 20, 1979, discloses a nursing garment which features a large front panel hinged at the top to cover an open, shaped area surrounding both breasts. When the fasteners are released along the bottom and sides of this open area the baby may be inserted under the panel to nurse. The baby is therefore, concealed from the mother's view and more importantly, the baby cannot see the mother.

Stagg U.S. Pat. No. 1,206,480, which issued on Nov. 28, 1916, discloses a double front nursing waist which features a completely detachable outer portion which is fastened at the shoulders and waist and which conceals the breast and face of the child during nursing. Nursing garments such as that disclosed by the Stagg Patent do not permit the child to view the mother. However, many mothers and specialists now recognize the importance of eye contact between the mother and the nursing child for promoting calm, steady nursing and for forming and maintaining the mother-child bond.

Pinch U.S. Pat. No. 4,004,294, which issued on Jan. 25, 1977, and Johnson U.S. Pat. No. 4,031,566, which issued on June 28, 1977, disclose shaped apertures which retain their shape when opened, thus permitting some flesh of the breast to be visible. Both utilize fastening systems, such as a Velcro loop or pile, which are necessary to insure modest coverage during nonfeeding times, but which tend to cause fuss and noise at the start and conclusion of feeding.

The nursing garments of the prior art discussed above permit at least a portion of the breast or the flesh adjacent to the nipple to be exposed during feeding. Some of them conceal the baby from the mother or conceal the mother from the baby. Many also are operative for feeding only after releasing and adjusting various fastening devices, which can be bothersome, abrasive and noisy, and may direct attention to the nursing pair. There is a need therefore, for a nursing garment which permits the mother and the baby to see each other's face without exposing the mother's breast, or any portion thereof, to onlookers. There is a further need for such a garment which permits covenient breast feeding without the fuss, bother, irritation, hazard and noise associated with fastening devices.

SUMMARY OF THE INVENTION

The present invention provides an improved front for clothing to be worn by a mother for breast feeding a child in a convenient, quiet and unobtrusive manner. "Front" as used herein shall mean that portion of the clothing intended in normal use to be positioned on the front of the woman.

The improved front of the clothing of the present invention includes an upper member having a lower edge, and a lower member having an upper edge. At least the upper edge of the lower member is made of such a resilient material that the upper edge tends to assume a nonaccess position and can be moved downwardly to an access position. The upper and lower members are so positioned relative to each other when worn by the woman that at least a portion of the upper member overlaps at least a portion of the lower member, and the nonaccess position is one in which the upper edge of the lower member is above the breast and the lower edge of the upper member is suspended to an area below the breast and below the upper edge of the lower member. The access position is one in which the upper edge of the lower member is pulled downwardly under the breast to make the breast accessible to the baby while the lower edge of the upper member remains suspended to the area below the breast to permit the upper member to shield the breast from view to all except the baby. Thus, in both the access and the nonaccess positions the lower edge of the upper member remains suspended to the area below the breast.

The upper and lower members of the clothing of the present invention may be independent members, unattached to each other. Alternatively, the upper and lower members may form a portion of a single garment.

The upper edge of the lower member may be so positioned on the lower member that the upper edge assumes a horizontal orientation in the nonaccess position relative to the woman when the clothing is worn. The upper edge of the lower member may alternatively be so positioned on the lower member that the upper edge assumes a diagonal orientation in the nonaccess position relative to the woman when the clothing is worn. "Diagonal" as used herein shall mean diagonal with respect to the horizontal and vertical as defined herein.

There may be a first and second upper edge of the lower member, the first upper edge being associated with one breast and the second upper edge being associated with the other breast. There may also be a first and second upper member, each having one lower edge. The lower edge of the first upper member overlaps the first upper edge and the lower edge of the second upper member overlaps the second upper edge. Each of the first and second upper members may include a means of attaching the lower edges of the first and second upper members to the lower member for use when the first and second upper edges of the lower member are in the nonaccess position.

Preferably, the clothing is so constructed that the upper member overlaps the lower member while the upper edge of the lower member is in the access position to an extent sufficient to shield the breast from view while permitting the baby to view the woman's face while the baby is feeding.

The lower edge of the upper member is preferably freely suspended, being unattached to the lower member. The upper member may be attached to the garment at some point other than along the lower edge.

In contrast to the aforementioned prior art garments, the clothing of the present invention has horizontal or diagonal edges, which can form accessways across the chest area. When the upper edge of the lower member is moved into the access position, an accessway is defined by the upper edge of the lower member and the lower edge of the upper member. The horizontal and diagonal designs cause the upper member, which overlaps the lower member, to fall over the breast obscuring it from view. The fabric forming the upper and lower members may be cut, folded and sewn to form curved, scalloped, variegated or straight horizontal or diagonal edges. The uppermost member continues to cover the breast entirely even when the lower member is stretched (not folded) down to slightly below the nipple. The baby's mouth tucks just under the upper member, enabling the child to nurse without exposing the mother's breast to the sight of any onlookers.

The stretchy upper edge of the lower member of the present invention, by virtue of its resiliency, tends to conform to the shape of the wearer. When in the nonaccess position, the lower member provides the mother double coverage over all or part of the breast area, letting her move and raise her arms without having the clothing gap apart even though the members are not fastened together. During feeding, when the upper edge of the lower member is pulled down to just below the nipple, it conforms to body contours rather than folding at a right angle or in some other manner to expose the breast. The upper member only shifts out slightly if at all. It need never be dropped down or lifted up and away from the breast, so that a bra or the breast is always covered entirely, at least by the upper member. Because no fastening system, such as Velcro, snaps, zippers or buttons, is required, unusual movements or sounds which would draw attention to the nursing couple are avoided.

The clothing may serve as the bodice of any type of women's apparel, such as a blouse, shirt, top of a dress, jumpsuit, or sportswear, loungewear, or sleepwear.

Furthermore, the clothing of the present invention can be adapted to conform to stylistic trends and the preferences of the wearer.

When not in use for feeding, the clothing of the present invention looks normal. The clothing can be worn with a variety of bras such as nursing bras, low cut bras or, if preferred, with no bra.

BRIEF DESCRIPTION OF THE DRAWINGS

The following detailed description of the preferred embodiment can be better understood if reference is made to the attached drawings in which.

DETAILED DESCRIPTION OF THE PREFERRED EMBODIMENTS

Figure 1:
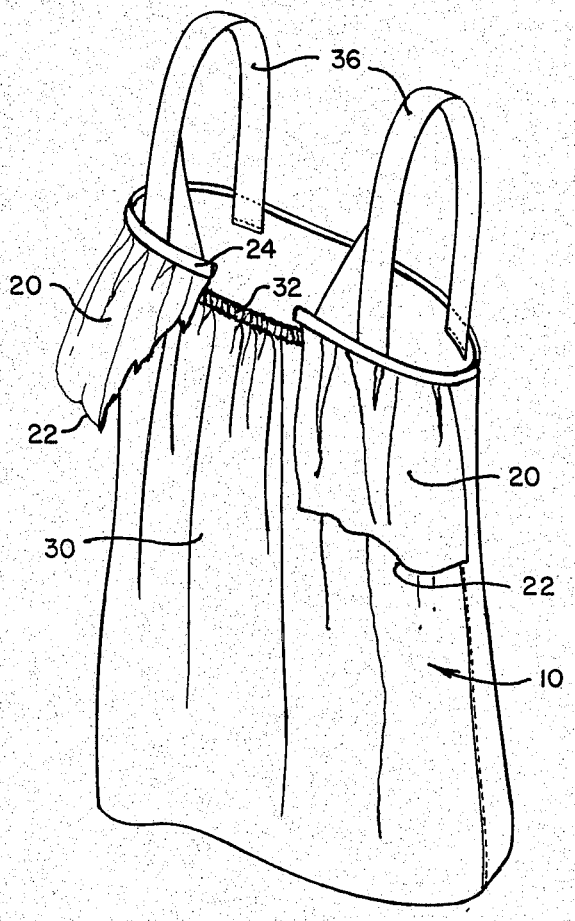
FIG. 1 is a perspective, cutaway view of one embodiment of the nursing clothing of the present invention.
Figure 2:
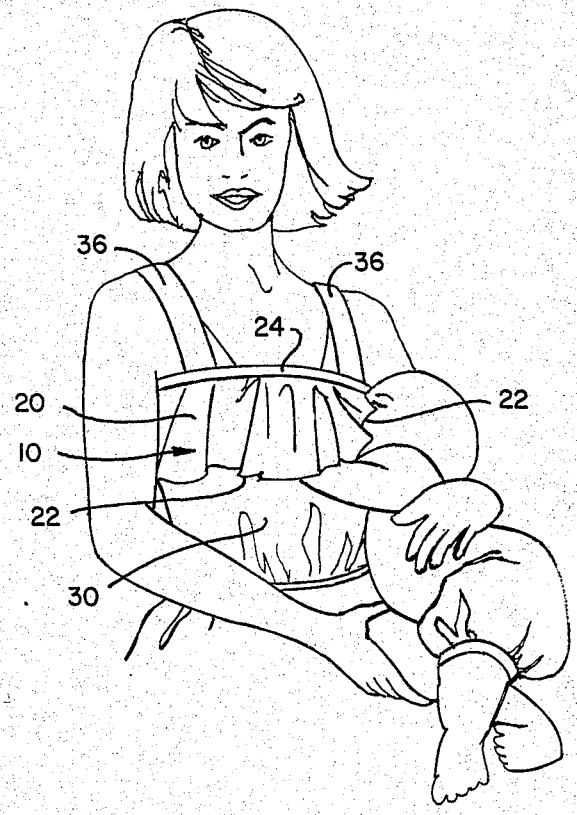
FIG. 2 is a view of the woman wearing the clothing of FIG. 1 while feeding the baby.

FIGS. 1 through 5 show one embodiment of the clothing, a nursing garment 10, of the present invention. The garment 10 accomplishes the purposes stated above by using overlapping fabric members having horizontal or diagonal orientation across the chest. Referring to FIG. 1, the garment 10 includes an upper member 20, and a lower member 30. Upper and lower members 20 and 30, respectively, may be attached in some suitable manner to each other. Alternatively, they may be unattached to each other, forming separate pieces. The separate pieces may be styled to permit a lower member 30 to be worn with a variety of interchangeable upper members 20 of different styles. Similarly, the separate pieces may permit an upper member 20 to be worn with a variety of interchangeable lower members 30.

Upper member 20 may be attached to a shoulder portion 36 or may itself form part of the shoulder portion 36. Shoulder portion 36 may take any form, such as straps across the shoulders in a sundress or to the back of the neck in a halter, or any conventional means for draping the garment over the shoulder of the wearer. Although the preferred embodiment includes a shoulder portion 36, such as that shown in FIG. 3, it should be understood that strapless garments may also be designed to incorporate the principal features of the present invention.

The upper member 20 includes lower edge 22 and upper edge 24. The upper member 20 continually covers the breast and is always visible to the wearer and others. At all times it remains generally undisturbed, falling over the breast due to gravity. It is attractively styled in keeping with the complete garment and ensemble.

The lower member 30 includes an upper edge 32 which is made of a resilient material. The resilient material of the upper edge 32 of the lower member 30 may be attached to nonresilient fabric of the lower member 30. Alternatively, the entire lower member 30 including the upper edge 32, may be made of such resilient material.

However, any suitable material, such as a stretchy lycra fabric or knit, or elasticized thread or band may be used, provided the upper edge 32 of lower member 30 is sufficiently resilient (a) to permit upper edge 32 to be pulled down to permit the baby to have access to the breast and (b) to allow upper edge 32 to return to the nonaccess position above the breast when released. The resiliency required is such that, when worn, upper edge 32 will naturally tend toward the nonaccess position, where both breasts are covered by lower member 30. When pulled downwardly, however, upper edge 32 will readily yield to permit ease of access for the child and minimum effort for the mother. When upper edge 32 is moved to the access position for feeding, an accessway is defined between the lower edge 22 of the upper member 20 and the upper edge 32 of the lower member 30.

In the nonaccess position, the lower member 30 is at least partially covered by the upper member 20, both of which cover all or most of the breast. Thus, even when the wearer raises her arms, the upper and lower members 20 and 30, do not fall apart to expose the breast.

Figure 3:
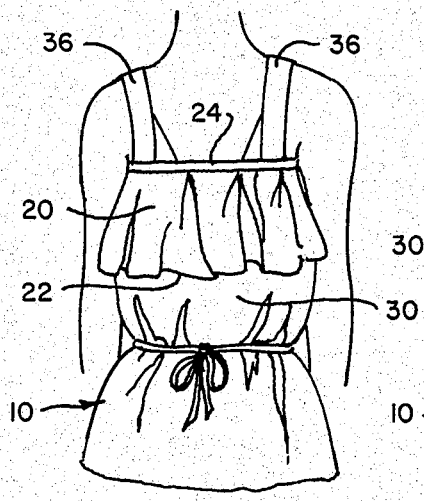
FIG. 3 is a view of the clothing shown in FIG. 1.
Figure 4:
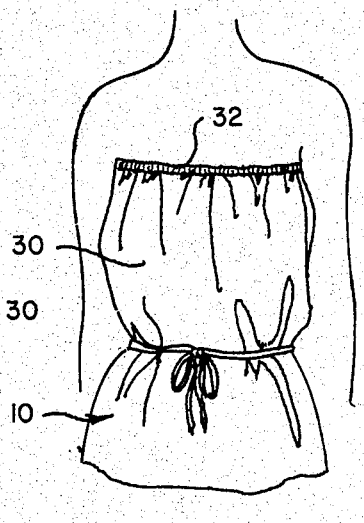
FIG. 4 is a view of the lower member of the clothing with the upper edge in the nonaccess position and, FIG. 5 is a view of the lower member of the clothing with the upper edge in the access position.
Figure 5:
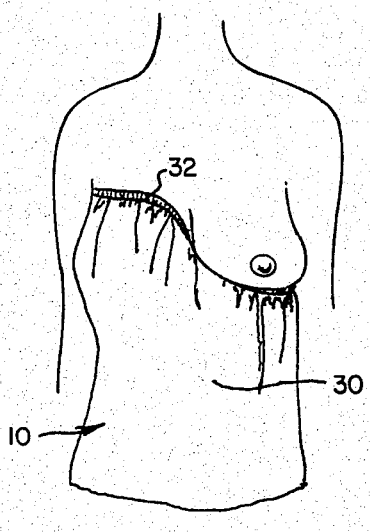

Lower member 30 in the access position is stretched by hand to the base of the breast and is there held by the natural configuration and weight of the breast itself. In the feeding or access position, the lower member 30 no longer covers the breast being given to the baby and may itself be covered less by the upper member 20. For the design having the horizontal upper edge, FIGS. 3, 4, and 5 illustrate a basic approach that can be incorporated into any bodice whether sleeved, or sleeveless, with straps or strapless. The upper member 20 includes one or more panels or ruffles across the chest that is an integral decorative part of the clothing or garment design. The upper member 20 is unattached at its lower edge 22 which, in the embodiment shown, extends along the base of the breast. Upper member 20 may however, be provided with a means for releasably attaching upper member 20 to lower member 30 for use when the woman is not nursing the child.

The upper member 20 may be attached by any suitable means along its upper edge 24 or its side edges to any suitable portion of the garment. For example, the side edges of the upper member 20 may be sewn to the side seams of the garment 10. As stated above, it may even be an integral part thereof. The lower edge 22 is suspended by gravity from the upper edge 24. When the mother leans forward slightly, the lower edge 22, again due to gravity, will fall away slightly from her body. With a small, silent movement of the mother's hand the upper edge 32 of the lower member 30 is tucked under her breast and the baby takes the nipple, unseen by others.

In the preferred embodiment, the upper member 20 should extend down over the breast far enough to conceal the breast from onlookers yet should not extend so far that the baby's head is entirely covered. Mothers have observed that feeding proceeds most smoothly when eye contact is maintained while feeding. In addition, psychologists have suggested that the bonding between mother and child is strengthened and the welfare of the child is enhanced if the mother and child can look into each other's faces while feeding. Therefore, upper member 20 should cover only the baby's mouth and should not obstruct the baby's view of the mother's face. The mother wearing garment 10 naturally holds the child in such a position that one or both of the baby's eyes can focus on the mother.

Following the feeding, the mother can unobtrusively release the lower member 30 from under her breast. The lower member 30 will naturally and silently ease back up over the breast to the nonaccess position to once again provide increased privacy and security.

The upper edge 32 of lower member 30 may have a conventional elastic band sewn therein or may be made of a stretch-knit fabric which is resilient enough to resume a nonaccess position when the feeding session is over. Elasticized thread or various stitch patterns which promote elasticity may also be employed. The lower member 30 may be attached to the garment 10 at side seams of the garment 10, generally corresponding to the sides of the wearer. The lower member 30 covers that portion of the wearer's body extending upwardly from generally the waist or above to the breast. The lower member 30 must extend from at least the base of the breast to a level which is higher in the nonaccess position than the lower edge 22 of upper member 20. Lower member 30 can also extend below the waist when garment 10 is a dress, jumpsuit or lingerie. The length and position of the upper edge 32 of lower member 30 determine the elasticity appropriate to a particular garment 10 to permit easy, comfortable access for nursing or breast pumping. Following feeding, the upper edge 32 must conveniently contract back to its nonaccess, nonnursing position.

The bodice of any type of women's garment, including a blouse, shirt, sweater, dress, sportshirt, loungewear or sleepwear may be adapted to incorporate the features of the present invention. In another embodiment of garment 10, (not shown) a diagonal design for upper edge 32 of lower member 30 may be used. This design may be incorporated into all sorts of garments to provide discreet access to the individual breast. The diagonal may include any stylistic modification of a diagonal, such as a V-shaped edge, without exceeding the scope of the present invention.

The upper member 20 of the garment 10 may assume a variety of shapes. Upper member 20 may be a plurality of pieces. Cowls, bibs, neck scarves, bands, ruffles, flounces, bows, dickeys, shawls, extended collars, a plurality of petal-shaped extensions, or any other suitable modification which would serve the purposes of the present garment 10 can be used. Those skilled in the art of fashion design will recognize that numerous stylistic modifications can be made to both the upper member 20 and lower member 30 without exceeding the scope of the present invention.

Similarly, numerous stylistic modifications can be made to the generally horizontally or diagonally oriented upper edges 32 of lower member 30 without exceeding the scope of the present invention. The edges may be straight or curved, regular or irregular, scalloped or variagated. The diagonal upper edge 32 can assume a V or W-shape.

The lower member 30 may be a garment having a V-shaped, oval or round neckline. The shaped neckline may function as upper edge 32. Any suitable modification of upper member 20, such as those described above, may be positioned over this embodiment of lower member 30.

There may be a first and a second upper edge 32 of lower member 30, the first upper edge being associated with one breast and the second upper edge being associated with the other breast. In the embodiment of the present invention having two upper edges 32, the upper member 20 may take the form of first and second individual members, one over each breast. They may be pockets, which can be functional or nonfunctional. The upper members 20 may alternatively be ensignia or any other useful or decorative attachments. In this embodiment, first and second pockets forming first and second upper members 20, may conceal the first and second upper edges 32 of lower member 30 under each pocket. The bottom edge of the first and second upper members 20, corresponding to lower edge 22 of upper member 20, are not sewn to the garment. However, some other means of releasable attachment, such as temporary closures may be used.

One embodiment of garment 10 provides shoulder straps for shoulder portion 36. The straps can be made of any suitable, desirable widths and they serve to provide bra coverage. In particular, a finished band folded in half over the top of the shoulder but unfolded adjacent to the connections at the front and back of garment 10 conceals any type of bra, including nursing bras which are often not as streamlined as nonnursing bras. The upper member 20 and the back of the garment 10 are suspended from the strap.

What is claimed is:

1. In clothing to be worn by a woman for breast feeding a baby, the improvement to the front of the clothing comprising:

an upper member having a lower edge;

a lower member having an upper edge, at least said upper edge being made of such a resilient material that said upper edge tends to assume a nonaccess position and can be moved downwardly to an access position;

said upper member and said lower member being so positioned relative to each other when worn by the woman that at least a portion of said upper member overlaps at least a portion of said lower member, and said nonaccess position is one in which said upper edge of said lower member is above the breast and said lower edge of said upper member is suspended to an area below the breast and below said upper edge of said lower member, and said access position is one in which said upper edge of said lower member is pulled downwardly under the breast to make the breast accessible to the baby while said lower edge of said upper member remains suspended to said area below the breast to permit said upper member to shield the breast from view to all except the baby.

2. The improvement as recited in claim 1 wherein said upper member and said lower member are independent members, unattached to each other.

3. The improvement as recited in claim 1 wherein said upper member and said lower member form a portion of a single garment.

4. The improvement as recited in claim 3 wherein said lower edge of said upper member is suspended freely, said lower edge being unattached to said lower member.

5. The improvement as recited in claim 1 wherein said upper edge of said lower member is so positioned on said lower member that said upper edge assumes a generally horizontal orientation in said nonaccess position relative to the woman when the clothing is worn.

6. The improvement as recited in claim 1 wherein said upper edge of said lower member is so positioned on said lower member that said upper edge assumes a generally diagonal orientation in said nonaccess position relative to the woman when the clothing is worn.

7. The improvement as recited in claim 1 wherein the clothing is so constructed that said upper member overlaps said lower member while said upper edge of said lower member is in said access position to an extent sufficient to shield the breast from view while permitting the baby to view the woman while the baby is feeding.

8. The improvement as recited in claim 1 wherein said lower member is made of a nonresilient fabric and said resilient material of said upper edge is attached to said nonresilient fabric.

9. The improvement as recited in claim 1 wherein said lower member is made from said resilient material.

10. The improvement as recited in claim 1 further comprising two straps for suspending said upper member on the woman, said straps being formed from a folded band of fabric, said band being unfolded adjacent said upper member.

11. The improvement as recited in claim 1 wherein there are first and second upper edges of said lower member, said first upper edge being associated with one breast and said second upper edge being associated with the other breast.

12. The improvement as recited in claim 11 wherein there are first and second upper members each having one said lower edge, said lower edge of said first upper member overlapping said first upper edge of said lower member and said lower edge of said second upper member overlapping said second upper edge of said lower member.

13. The improvement as recited in claim 12 wherein each of said first and second upper members includes a means for releasably attaching said lower edges of said first and second upper members to said lower member for use when said first and second upper edges of said lower member are in said nonaccess position.

14. The improvement as recited in claim 1 wherein said upper member is a plurality of pieces.

15. The improvement as recited in claim 1 further comprising a means of releasably attaching said upper member to said lower member for use when said upper edge of said lower member is in said nonaccess position.

* * * * *